US007617586B2

(12) United States Patent
Cagliari et al.

(10) Patent No.: US 7,617,586 B2
(45) Date of Patent: Nov. 17, 2009

(54) METHOD OF MANUFACTURING METAL ACCESSORY FOR A SPORTS SHOE

(75) Inventors: Peter Cagliari, Montebelluna (IT); Andrea Fregoni, Paese (IT)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 11/389,774

(22) Filed: Mar. 27, 2006

(65) Prior Publication Data

US 2006/0236508 A1 Oct. 26, 2006

(30) Foreign Application Priority Data

Apr. 21, 2005 (EP) ..... 05425253

(51) Int. Cl.
*B23P 13/04* (2006.01)
*A43C 11/00* (2006.01)

(52) U.S. Cl. ..... 29/557; 24/68 SK

(58) Field of Classification Search ..... 29/557, 29/558; 36/59 C, 127, 83, 88, 101, 103, 36/136, 138, 59 R, 66; 24/68 SK
See application file for complete search history.

(56) References Cited

U.S. PATENT DOCUMENTS

| | | | | | |
|---|---|---|---|---|---|
| 1,905,961 | A | * | 4/1933 | Edwards | 33/36 |
| 2,236,547 | A | * | 4/1941 | Monfils | 12/41.05 |
| 4,674,156 | A | | 6/1987 | Olivieri | 24/71 |
| 4,885,851 | A | * | 12/1989 | Peterson | 36/127 |
| 6,075,221 | A | | 6/2000 | Minhas | 219/121.68 |
| 6,332,379 | B1 | | 12/2001 | Klomp | 81/60 |

FOREIGN PATENT DOCUMENTS

| | | |
|---|---|---|
| EP | 1 369 050 A1 | 12/2003 |
| GB | 2 306 375 A | 5/1997 |

* cited by examiner

*Primary Examiner*—John C Hong
(74) *Attorney, Agent, or Firm*—Frommer Lawrence & Haug LLP; Ronald R. Santucci

(57) ABSTRACT

Metal accessory for a sports shoe of the buckle type, comprising a decoration and/or gripping zone (10) on its upper surface (2), wherein this decoration and/or gripping zone (10) comprises reliefs formed by the intersection of at least two non-parallel series of grooves.

2 Claims, 3 Drawing Sheets

METHOD OF MANUFACTURING METAL ACCESSORY FOR A SPORTS SHOE

This application claims priority benefits from European Patent Application No. 05425253.1 filed Apr. 21, 2005.

The invention relates to a metal accessory for a sports shoe, equipped with an uneven surface, with reliefs, to facilitate its gripping and manipulation and improve its aesthetic quality. The invention also relates to a method of manufacturing such an accessory and also a sports shoe equipped with such an accessory. It is particularly suitable for metal buckles of the closing and clamping devices of ski boots.

BACKGROUND OF THE INVENTION

In the majority of cases, sports shoe metal accessories of the prior art have an even, smooth surface. This results in a first disadvantage for the accessories and the fixing buckles of ski boots, which slip in the hands when they are manipulated. A second disadvantage results from the fact that the aesthetic quality of these accessories is very plain.

DESCRIPTION OF THE PRIOR ART

To remedy the above disadvantages, certain ski boot metal buckles of the prior art comprise a grooved surface. According to a first manufacturing method, such buckles are obtained by molding. However, this manufacturing method is costly, and the buckle obtained does not have satisfactory solidity. According to a second manufacturing method, such buckles are obtained by extrusion followed by machining, the grooves being formed on a surface of the section during extrusion, in the direction of extrusion. The buckle obtained is then more solid. These solutions still have the disadvantages of forming a surface of which the ease of gripping proves to be insufficient, simple grooves not solving fully the problems of the fingers slipping. Furthermore, the aesthetic quality of these buckles remains very basic and not very varied. For example, the extrusion method necessarily ends in transverse grooves extending over the entire width of the buckle.

SUMMARY OF THE INVENTION

A first object of the present invention consists in a metal accessory for a sports shoe which is easy to grip.

A second object of the present invention consists in a metal accessory for a sports shoe which is equipped with a decoration.

A third object of the present invention consists in an economical method of manufacturing a metal accessory for a sports shoe which is easy to manipulate and has a decoration.

The invention proposes producing a decoration and/or gripping zone on the metal accessory which comprises reliefs formed by the intersection of at least two non-parallel series of grooves and produced by a knurling technique or a method based on specific extrusion and milling.

The invention is defined more precisely by the claims.

DESCRIPTION OF THE DRAWINGS

These objects, characteristics and advantages of the present invention will be explained in detail in the description below of particular embodiments which are illustrated by way of non-limiting example with reference to the accompanying figures, in which.

DESCRIPTION OF THE PREFERRED EMBODIMENT(S)

The invention is illustrated within the context of a buckle or lever of a closing and clamping device of a ski boot.

According to a first manufacturing method, the buckle is obtained mainly by a first, extrusion stage followed by a second, milling stage.

The first stage consists in manufacturing a metal section in the form of a long bar several meters in length by extrusion. During this stage, a surface of the section is deliberately provided with rectilinear grooves oriented in the direction of displacement of the section during extrusion.

Figure 1:
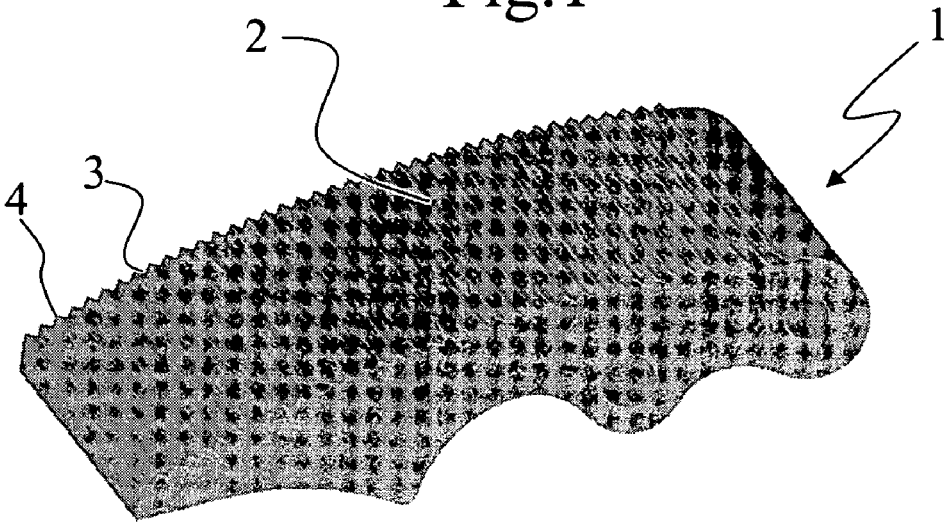
FIG. 1 is a perspective view of a sports shoe buckle after an initial phase of its manufacturing method according to a first embodiment of the invention.

FIG. 1 illustrates an element 1 obtained directly after transverse cutting of the section obtained during the first, extrusion stage. This element 1 comprises a grooved upper surface 2, the grooves 3 of which are transverse to the element 1 and define transverse ribs 4 located between the grooves 3. These grooves 3 form the first series of grooves of the buckle being produced.

Figure 2:
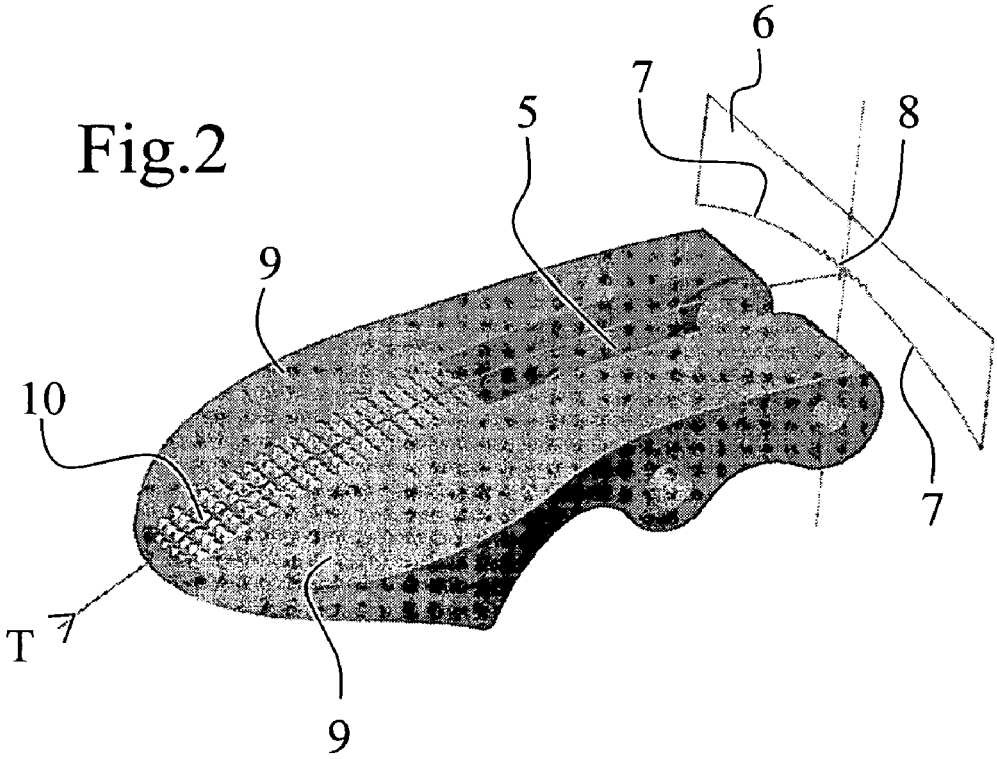
FIG. 2 is a perspective view of the sports shoe buckle in FIG. 1 in the final phase of its manufacturing method.

The second essential stage of this method consists in a milling stage with the aid of a mill 6 which shapes the upper surface 2 of the buckle during longitudinal displacement in the direction of the arrow F in FIG. 2. According to the concept of the invention, this mill 6 comprises a cutting profile 8 which does not cut the grooves 3 and ribs 4 of the element 1 completely but uses them to form a decoration and/or gripping zone 10 on the surface 2 of the buckle by superposing on them a second, intersecting series of essentially rectilinear, parallel and juxtaposed grooves oriented differently to the grooves of the first series.

In the example shown in FIG. 2, the mill 6 comprises an on the whole rounded cutting profile in order to form an on the whole convex upper surface 2 of the buckle. Furthermore, it comprises lateral cutting profiles 7 which will cut away completely the grooves of the element 1 so as to form smooth, rounded lateral surfaces 9 on the buckle, and a central cutting profile 8 which will produce a second series of longitudinal grooves on the surface of the buckle with a depth and spacing similar to the transverse grooves of the element 1 in this variant.

Figure 3:
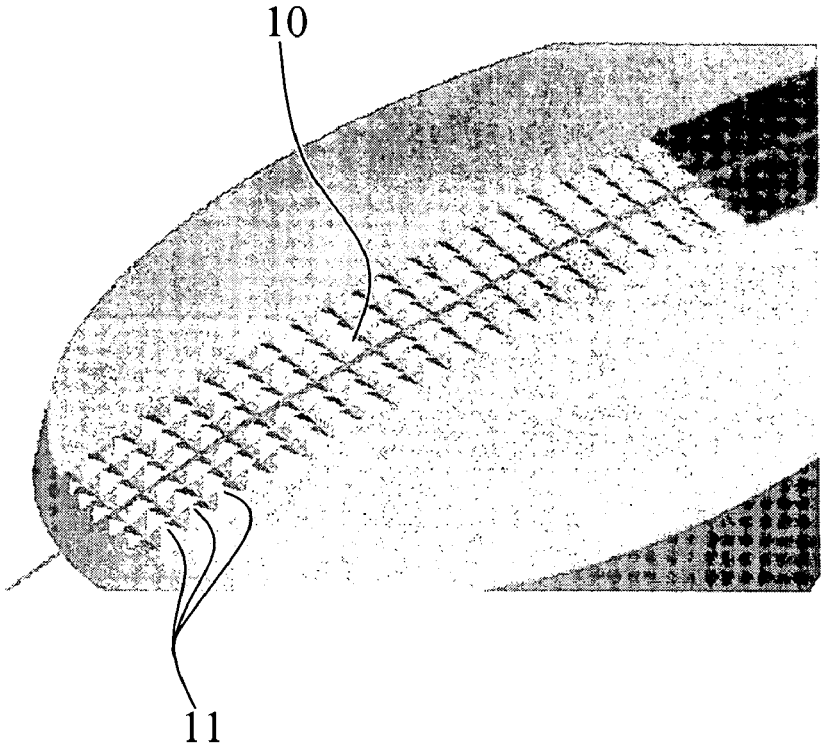
FIG. 3 is an enlarged view of details in FIG. 2.

The result obtained by the superposition or intersection of the series of longitudinal and transverse grooves is an uneven decoration and/or gripping zone 10 shown in close-up in FIG. 3. This zone is granular, has reliefs, and more precisely comprises a multitude of small protuberances 11 brought about by the intersection of the longitudinal and transverse ribs 4 formed by the superposition or intersection of the longitudinal and transverse grooves. These protuberances or projections are therefore located above the level of the rest of the surface of the buckle outside the zone 10, in particular of the neighboring surfaces 9. The zone with reliefs 10 corresponds in its size and position to the positioning of the fingers of a user who is going to manipulate the buckle and thus makes it possible to improve his grip while creating an attractive aesthetic effect. For these reasons, this zone will be called a decoration and/or gripping zone 10.

According to a variant of the previous manufacturing method, the cutting of the section resulting from the first, extrusion stage to form the basic elements with the dimensions of the buckle being produced can be carried out after the second stage of milling the grooved upper surface. Furthermore, the manufacturing method can moreover comprise the other conventional stages of the prior art such as cutting and drilling operations to form, for example, the opening 5 which makes rotatable connection of the buckle to a base possible and allows it to receive a rod.

This method easily makes it possible to produce a multitude of decoration zones 10 with different shapes and varied aesthetic qualities by simple modification of the cutting profile 8 of the mill 6 to modify, for example, the shape of the grooves, that is to say their angle, depth, width, and also their spacing. The use of the mill also makes it possible to choose the direction of the second series of grooves and to choose the shape of the final surface of the buckle, which is convex in this form of realization. In the same way, the grooves of the first series, formed by extrusion, can also have different shapes according to their angle, depth, width, spacing etc.

Furthermore, the intersection of grooves in two different directions makes it possible to produce a good gripping zone which is markedly improved in relation to the simple grooves of the prior art.

Figure 4:
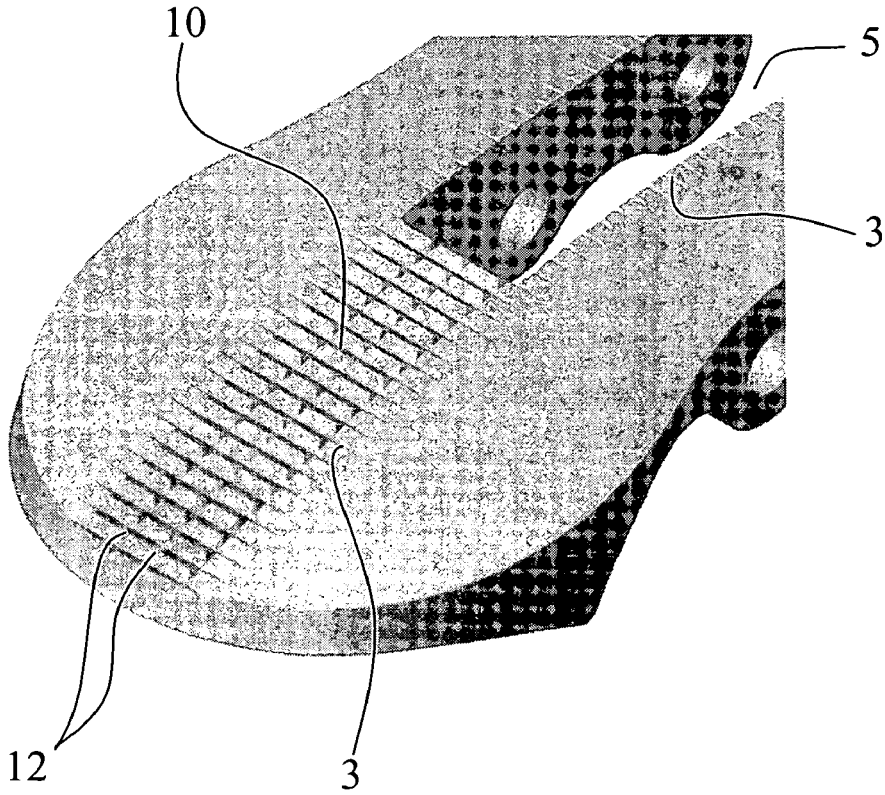
FIG. 4 is a buckle obtained according to a variant.
Figure 5:
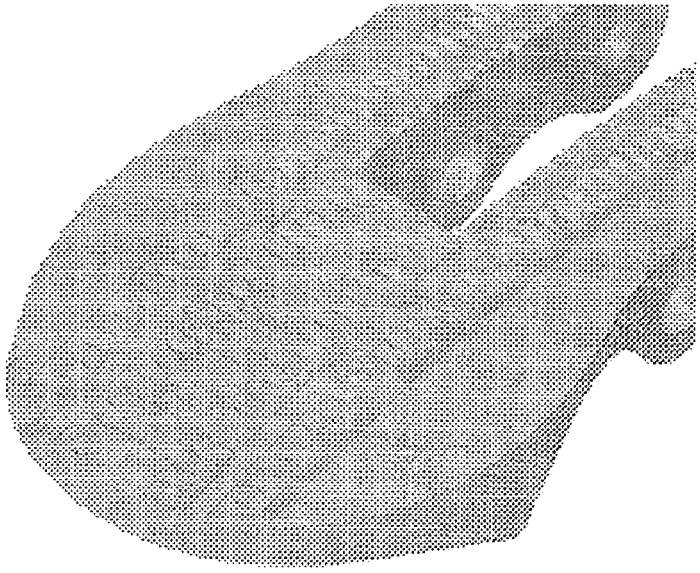
FIG. 5 is a buckle obtained according to another variant.

In application of the previous remarks, FIGS. 4 and 5 illustrate variants of the decoration and/or gripping zone 10 on the surface of the buckle.

FIG. 4 illustrates a variant in which the mill 6 leaves some parts of the first series of grooves 3 visible on a surface around the central opening 5 of the buckle, which parts extend over the entire length of the buckle, followed by a zone in which the first series of grooves of the element 1 is divided into three parts by two longitudinal grooves 12 of a depth close to that of the grooves 3, these two grooves 12 constituting a second series of grooves. This realization likewise makes it possible to achieve a decoration and gripping zone 10 which facilitates manipulation of the buckle and provides it with an attractive aesthetic quality. In a variant which is not illustrated, the grooves of the first series, produced by extrusion, could be relatively widely spaced and wider, the grooves of the second series then having a small spacing so as to create relatively fine reliefs.

FIG. 5 illustrates another variant, likewise obtained by allowing some ribs 4 and grooves 3 of the element 1 to show and superposing on them a second series of grooves in certain predefined zones by means of an adapted cutting profile 8 of the mill 6. In this realization, the decoration and gripping zone occupies a larger surface area overall on the buckle and improves its gripping with the hand, in particular also toward the zone comprising the opening 5. Lastly, it becomes clear that this first manufacturing method has the following advantages:

- as the decoration and/or gripping zone is obtained by the simple intersection of two non-parallel series of essentially rectilinear grooves, that is to say the two series are oriented in different directions, the surface obtained has numerous reliefs with multiple orientations and constitutes a good gripping zone;
- furthermore, since at least one series of grooves can be modified easily during the manufacturing method according to several parameters, it is possible to form a multitude of different designs on the surface of the buckle. It is thus possible to manufacture buckles with varied decorations. As a variant, it is possible for more than two series of grooves in different directions to intersect;
- the use of a second stage of milling, which superposes a second series of grooves on the grooves obtained during extrusion, allows greater flexibility during extrusion: the shape, quantity, position and accuracy of the grooves produced during extrusion are parameters which are markedly less important than in the prior art because the result is destined for extensive finishing in the subsequent milling stage. The first, extrusion stage therefore produces grooves which are adapted to the reliefs the second, milling stage is to produce. For example, it is possible to produce these grooves over a surface area of the extruded section which is larger than the final decoration and/or gripping zone because this surface area can then be smoothed by the milling stage;
- furthermore, the same extruded section can be used for forming a multitude of solutions with different aesthetic qualities, which is very advantageous.

Figure 6:
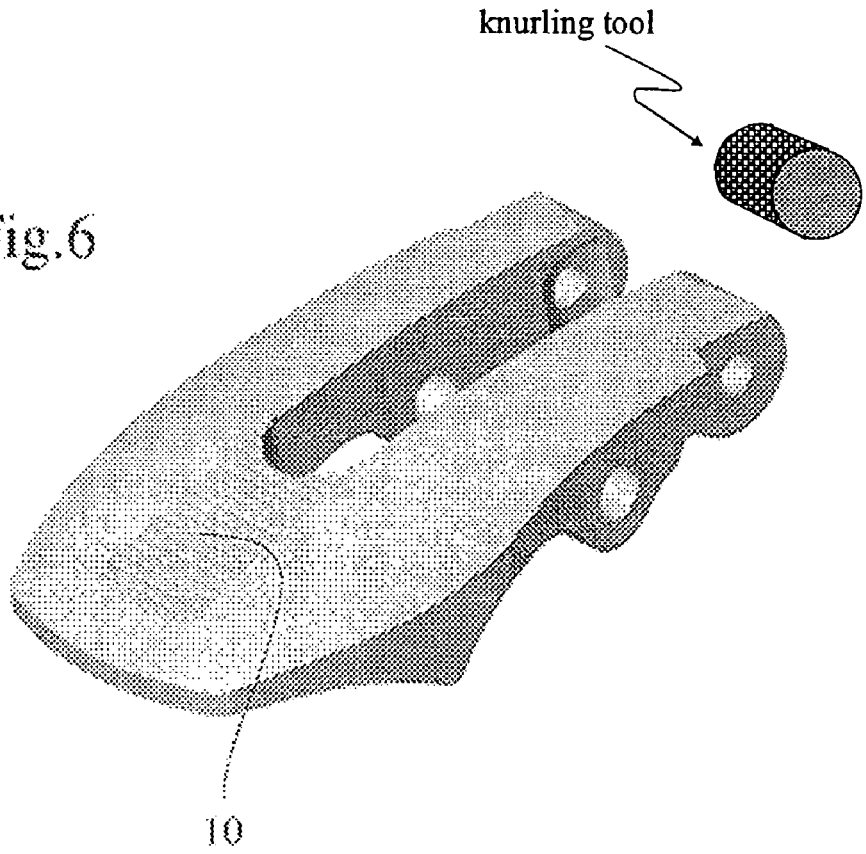
FIG. 6 is a buckle obtained according to a second embodiment of the invention.

According to a second manufacturing method, the buckle is first produced in a conventional manner by possibly and advantageously forming a zone in relief or a recessed zone on its upper surface, which is intended to become the decoration and/or gripping zone of the buckle. Then, such a zone is finished by a conventional knurling technique so as to obtain a decoration and/or gripping zone 10 with a knurled surface, the form of which depends on the knurling tool used. According to the concept of the invention, this knurling tool will be such that it produces reliefs formed by at least two non-parallel series of grooves. This method also makes it possible to form reliefs comprising protuberances which project in relation to the original surface of the buckle. FIG. 6 illustrates a buckle obtained by this second method, for example.

The invention has been described within the context of a buckle for a ski boot but is easily adapted to any metal accessory for sports shoes. It is also applicable for decorating accessories which do not require any significant manipulation. The decoration and/or gripping surface has been illustrated as being centered on the accessory but could also be located off-center, on one side, so as to form an aesthetic quality by asymmetry.

Furthermore, the invention has been described with rectilinear grooves, but the same concept could be implemented with series of grooves which are not necessarily rectilinear: however, each series will not be parallel to the other superposed series.

Lastly, this solution therefore has the following advantages:

- it makes it possible to facilitate gripping and manipulation of the metal accessories by virtue of a special zone which makes it possible to reduce slipping when gripped with the hand;
- it readily allows the production of a multitude of shapes and designs and therefore the production of a multitude of different decorations and aesthetic qualities of the sports shoe accessories;
- it is based on several inexpensive manufacturing methods.

The invention claimed is:

1. A method of manufacturing a metal buckle for a sports shoe comprising a decoration and/or gripping zone (10) on its upper surface (2), wherein this decoration and/or gripping zone (10) comprises reliefs formed by the intersection of at least two series of grooves which are non-parallel to each other, said method comprising the following stages: formation during an extrusion of a first series of grooves (3) adapted to the shape of the reliefs desired in the following stage on a surface of a metal section intended to form the buckle after it has been cut; milling of all or part of the grooved surface formed in the first stage to cause a second series of grooves that are non-parallel to and intersects the first series of grooves (3) so as to form the decoration and/or gripping zone (10) comprising reliefs on the upper surface (2) of the accessory.

2. The method of manufacturing a metal buckle for a sports shoe as claimed in claim 1, wherein: the milling also includes the production of smooth surfaces (9) by cutting away completely part of the grooves (3) of the first series of grooves.

* * * * *